United States Patent [19]

Koch

[11] Patent Number: 4,494,362

[45] Date of Patent: Jan. 22, 1985

[54] PACKAGE FORMING WEB FOLDER

[75] Inventor: Keith C. Koch, Westwood, Iowa

[73] Assignee: Metromail, Inc., Mt. Pleasant, Iowa

[21] Appl. No.: 247,109

[22] Filed: Mar. 24, 1981

[51] Int. Cl.[3] ..... B65B 9/06

[52] U.S. Cl. ..... 53/550; 493/302; 493/440

[58] Field of Search ..... 53/550, 220, 562, 568, 53/372, 551; 493/248, 302, 440, 439, 438

[56] References Cited

U.S. PATENT DOCUMENTS

| | | | |
|---|---|---|---|
| 516,186 | 3/1894 | Crowell | 53/550 X |
| 3,303,630 | 2/1967 | Harm | 53/550 X |
| 3,420,035 | 1/1969 | Deans et al. | 53/550 |
| 3,426,499 | 2/1969 | Paige | 53/551 X |
| 3,532,516 | 10/1970 | Erekson | 53/550 X |
| 3,653,177 | 4/1972 | Adams et al. | 53/550 |
| 3,664,088 | 5/1972 | Sherman | 53/551 X |
| 3,732,789 | 5/1973 | Hartleib | 53/562 X |
| 4,084,999 | 4/1978 | Rucker | 53/551 X |
| 4,216,638 | 8/1980 | Yoshida | 53/550 X |
| 4,430,845 | 2/1984 | Dohrendorf | 53/550 |

FOREIGN PATENT DOCUMENTS

| | | | |
|---|---|---|---|
| 928606 | 6/1963 | United Kingdom | 53/550 |

*Primary Examiner*—Horace M. Culver

*Attorney, Agent, or Firm*—Harvey B. Jacobson

[57] ABSTRACT

A travelling web made of packaging film is folded about collated sheets of material in response to a reversal in travel direction of the web about an arrangement of three guide edge segments. Two of the guide edge segments on either side of the intermediate guide edge segment form parts of two triangular folding guide members through which the web is folded into transversely overlapping portions overlying an intermediate portion reversed in travel direction by the intermediate guide segment.

13 Claims, 9 Drawing Figures

Fig. 1
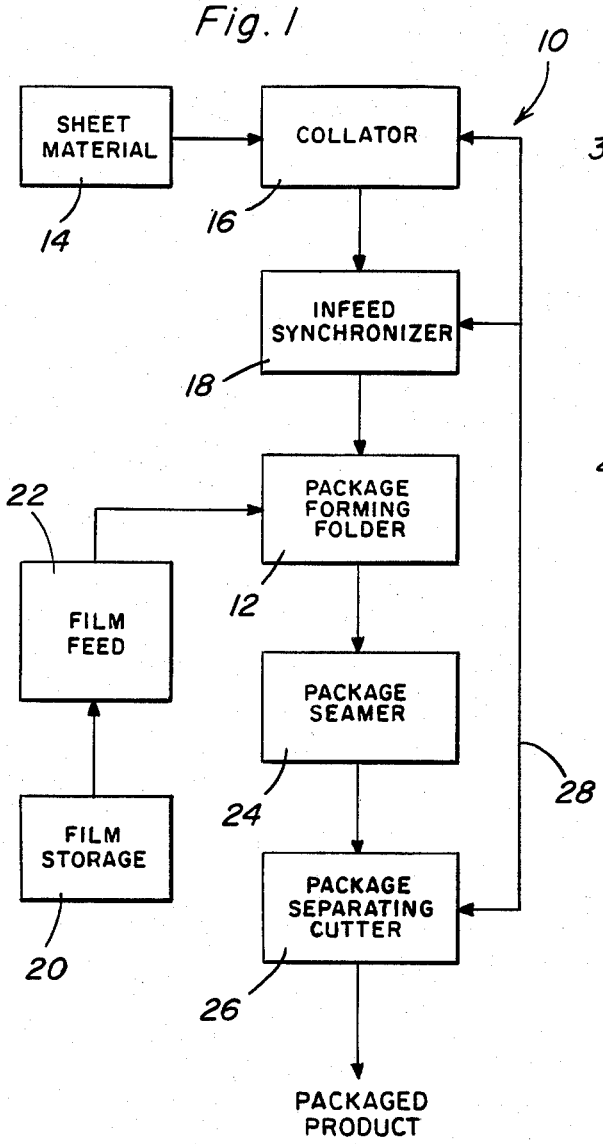
Fig. 2
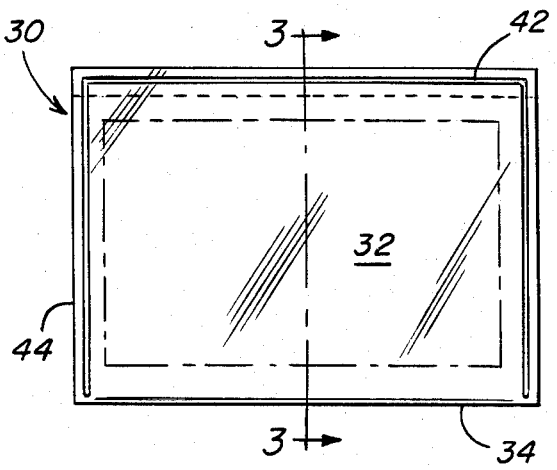
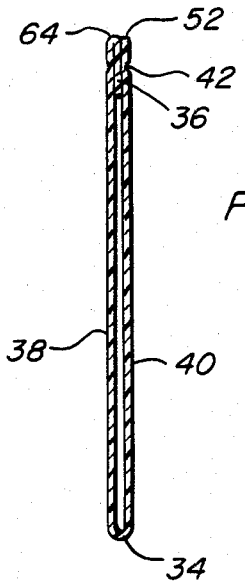
Fig. 3
Fig. 6
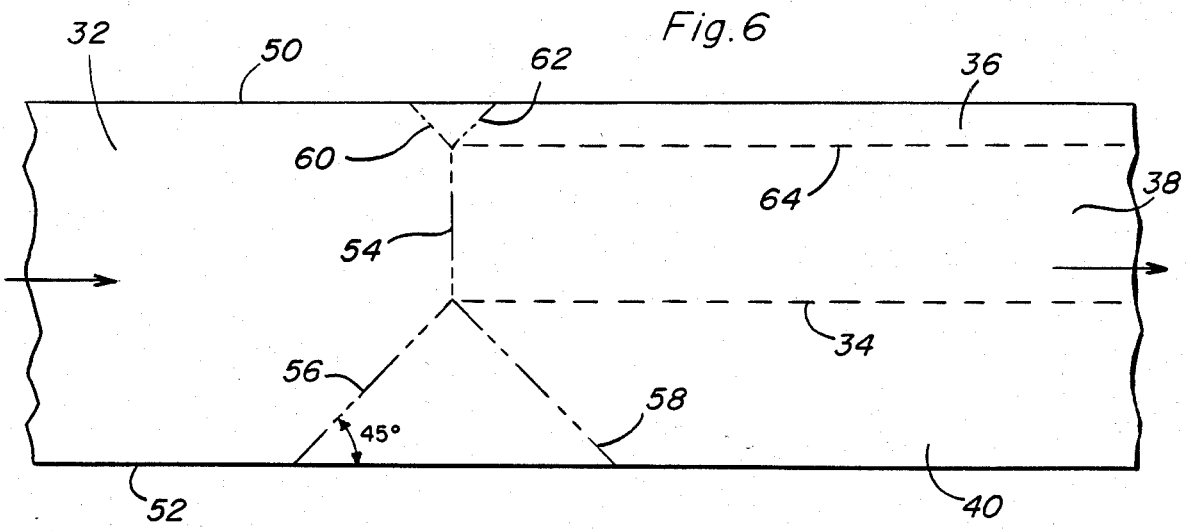

PACKAGE FORMING WEB FOLDER

BACKGROUND OF THE INVENTION

This invention relates to the folding of travelling film webs in a package forming system.

The automatic folding of a travelling web of sheet material during a change in its travel direction to form an envelop-type package is generally known. Folding formers performing the foregoing folding function usually fold the web along a single fold line parallel to the direction of travel during a single fold forming operation. Any additional folds required would ordinarily call for additional folding operations. Further, such folding operations are not readily adaptable to the folding of webs of different width so as to render the packaging equipment limited to single size packages.

The foregoing type of folding formers are particularly useful in packaging systems wherein sheets of collated material are wrapped in the web film during the folding operation in order to produce a packaged product. However, the package formed cannot be tailored in size to the sheets enclosed therein by any simple adjustment of the equipment. Further, in the absence of additional folding operations, seaming is limited to unfolded edge portions of the web material in the formation of the package.

It is therefore an important object of the present invention to provide a package forming folder device of the aforementioned type that produces at least two folds during a single folding operation on a travelling web and which is readily adjustable to accommodate webs of different widths in order to meet varying dimensional requirements for the package.

SUMMARY OF THE INVENTION

In accordance with the present invention, a travelling web is reversed in travel direction at a product receiving edge segment of a fixed, product supporting surface member along which the web travels in opposite directional senses to and from an approaching product. At each end of the edge segment, a pair of edge segments extend at 90° to each other to form part of a triangular folding guide member closely spaced above the supporting surface member in order to guide two 90° changes in direction of travel of a transverse portion of the web while the intermediate transverse portion of the web undergoes a single 180° reversal in directional sense at the product receiving edge segment. The web is thereby folded in sequence along two fold lines parallel to its direction of travel forming two overlapping side portions of a flat tube, one of which is smaller than the other so as to constitute a seam lap. The smaller of the triangular folding guide members producing the seam lap is spaced from the larger folding guide member by an adjusted amount so as to accommodate webs of different widths. The adjustment is effected through a screw and nut mechanism interconnecting the supporting surface member with a slide plate on which the smaller folding guide member is mounted adjacent one of the longitudinal edges of the unfolded web.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

FIG. 1 is a block diagram schematically illustrating a product packaging system with which the present invention is associated.

FIG. 2 is a plan view of an envelop package produced in accordance with the present invention.

FIG. 3 is a transverse section view taken substantially through a plane indicated by section line 3—3 in FIG. 2.

FIG. 6 is a plan view of the travelling web unfolded to show the folding guide lines and fold lines associated with the folding operation depicted in FIGS. 4 and 5.

DETAILED DESCRIPTION OF PREFERRED EMBODIMENT

Figure 4:
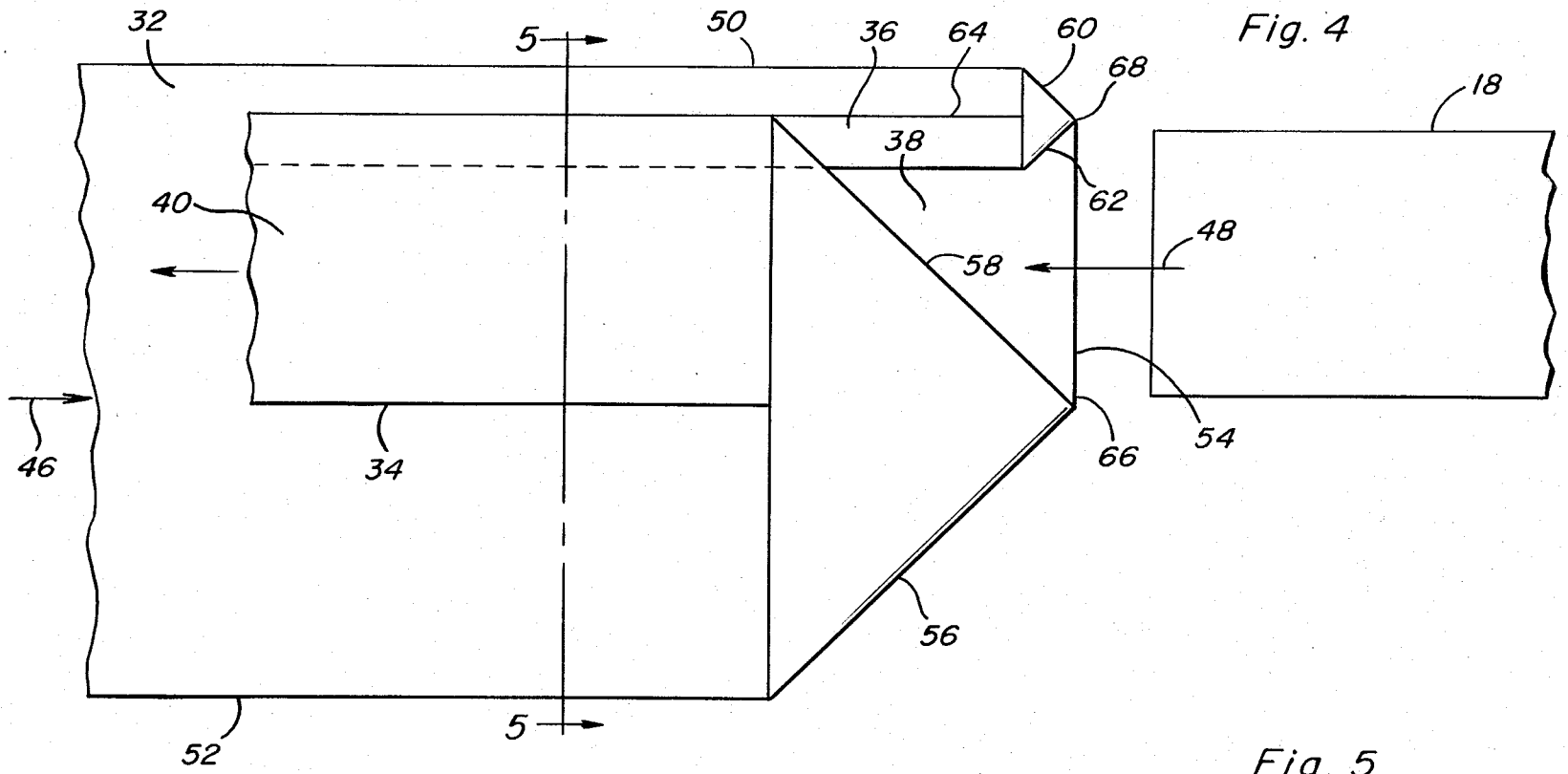
FIG. 4 is a top plan view showing travel of a web undergoing a folding operation in accordance with the present invention.

Referring now to the drawings in detail, FIG. 1 schematically illustrates a product packaging system, generally referred to by reference numeral 10, with which the package forming folder 12 of the present invention may be associated. The product delivered to the folder 12 is in the form of collated sheets of material derived from a source 14 fed to a collator 16 from which the product is fed by an infeed synchronizer 18 to the folder 12. A travelling web of packaging film withdrawn from a storage roll 20 is fed through the folder 12 by a feeder 22 to wrap the product in the packaging film before it is fed to a package seamer 24 by means of which the product is sealed within the folded film web. The product packages are separated from each other by a folded web cutter 26. Operation of the cutter is synchronized through a drive connection 28 with the infeed synchronizer and the collator 16.

A rectangular flat envelop type of package 30 produced in accordance with the present invention is shown in FIGS. 2 and 3. The package is formed from a web of film 32 that is folded along a fold line 34 parallel to the direction of web travel. A folded lap portion 36 of the web secures folded side portions 38 and 40 of the package to each other along a heat sealed seam 42 formed by the package sealer 24. The seam 42 also extends in close spaced adjacency to cut edges 44 of the web at which the packages are separated from each other.

Figure 5:
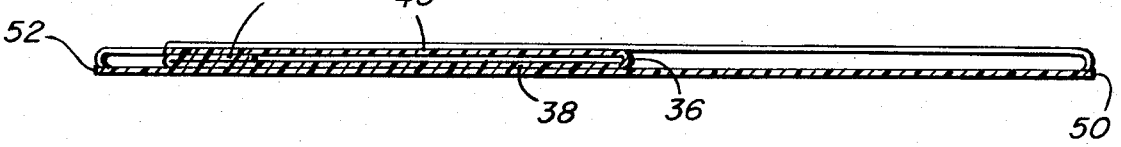
FIG. 5 is a transverse view taken substantially through a plane indicated by section line 5—5 in FIG. 4.

Folding of the web 32 within the folder 12 in accordance with the present invention is shown in FIGS. 4, 5 and 6. The web in its flat, unfolded state is fed in one directional sense as indicated by arrow 46 in FIG. 4 along the path of travel toward the product approaching in the opposite directional sense, as indicated by arrow 48, from the infeed synchronizer 18. The longitudinal edges 50 and 52 of the unfolded web are parallel to the direction of travel. As the unfolded web approaches the product it undergoes a complete reversal in directional sense at a direction changing edge segment 54 perpendicular to the direction of travel and spaced from both longitudinal edges 50 and 52 of the unfolded web to form the side portion 38 of the folded web intermediate the longitudinal edges 50 and 52. The other transverse folded portions 36 and 40 of the web each undergo two 90° changes in direction of travel along the edge segments 56, 58 and 60, 62 to effect both folding of the web along fold lines 34 and 64 and reversal in the directional sense of travel. The edge segments 56 and 58 are therefore at right angles to each other substantially intersecting at one end of edge segment 54 to form a vertex bisected by the fold line 34. Similarly, the edge segments 60 and 62 intersect at a 90° vertex 68 at the end of edge segment 54 bisected by fold line 64. The vertices 66 and 68 are transversely spaced from each other by the edge segment 54 while the edge segments 58 and 62 transversely overlap so that the folded portions 40 and 36 overlap in overlying relation to the intermediate portion 38 of the folded web as shown. The transversely overlapping edges 58 and 62 do not intersect but are longitudinally spaced from each other because the edges 60 and 62 are substantially smaller in dimension along the direction of travel than the edges 56 and 58 as seen in FIG. 4. Also shown in FIG. 4 is the folding of web portion 36 during its travel in the direction of arrow 48 a distance less than the distance traveled before folding of web portion 40 is completed. Accordingly, folding of web portion 36 is completed before there is any overlapping contact with web portion 40. The locations of the stationary edge segments 54, 56, 58, 60 and 62 and fold lines 34 and 64 on the web in unfolded form are shown in FIG. 6.

Figure 9:
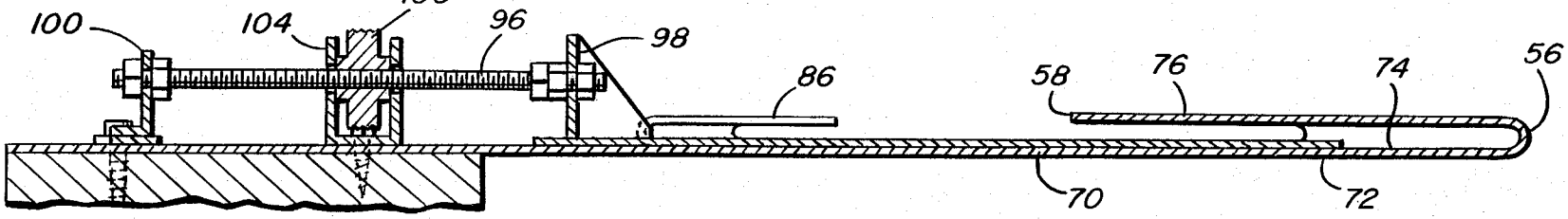
FIG. 9 is a section view taken substantially through a plane indicated by section line 9—9 in FIG. 7.
Figure 7:
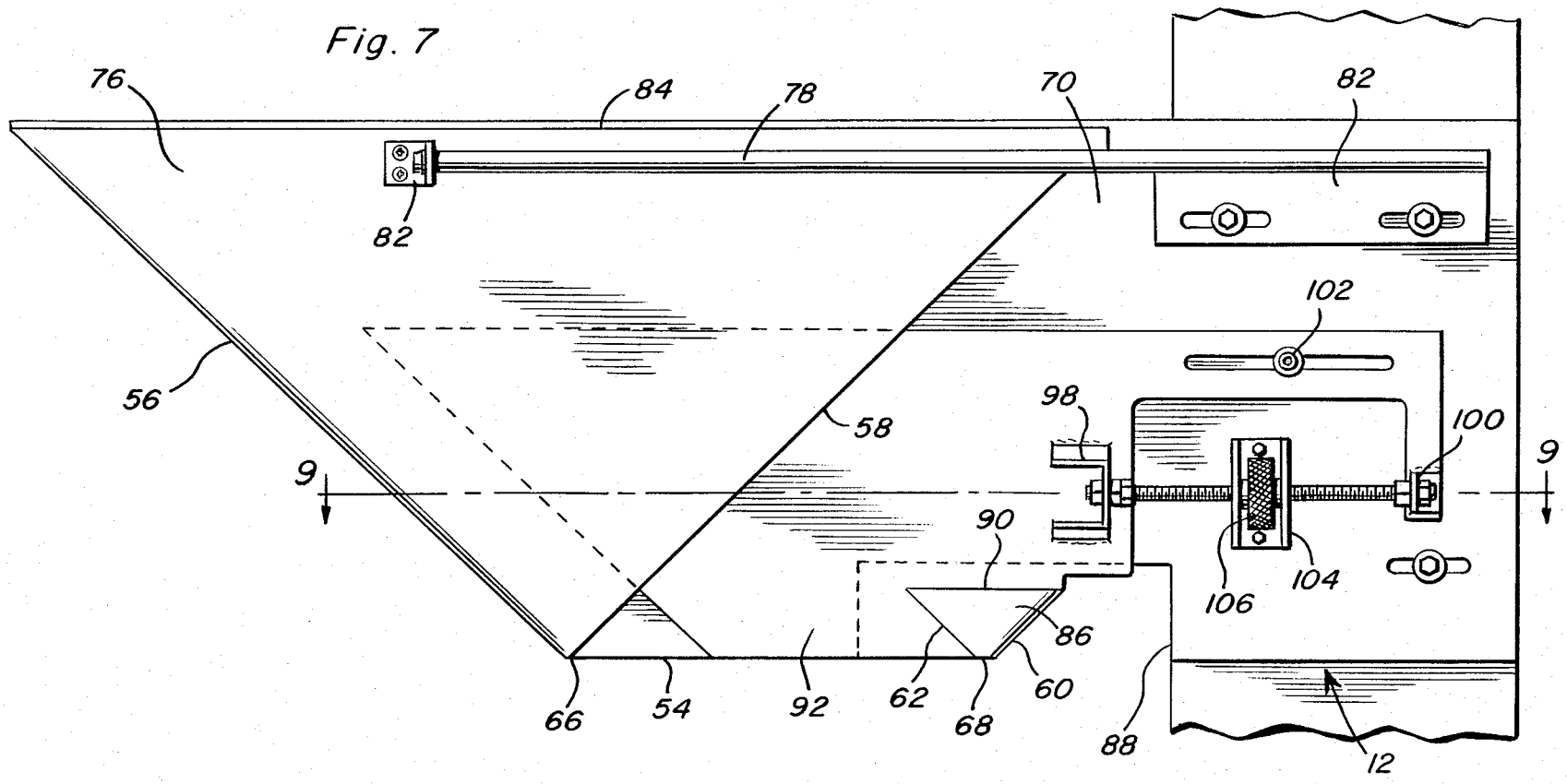
FIG. 7 is a top plan view of the package forming folder apparatus associated with the present invention.
Figure 8:
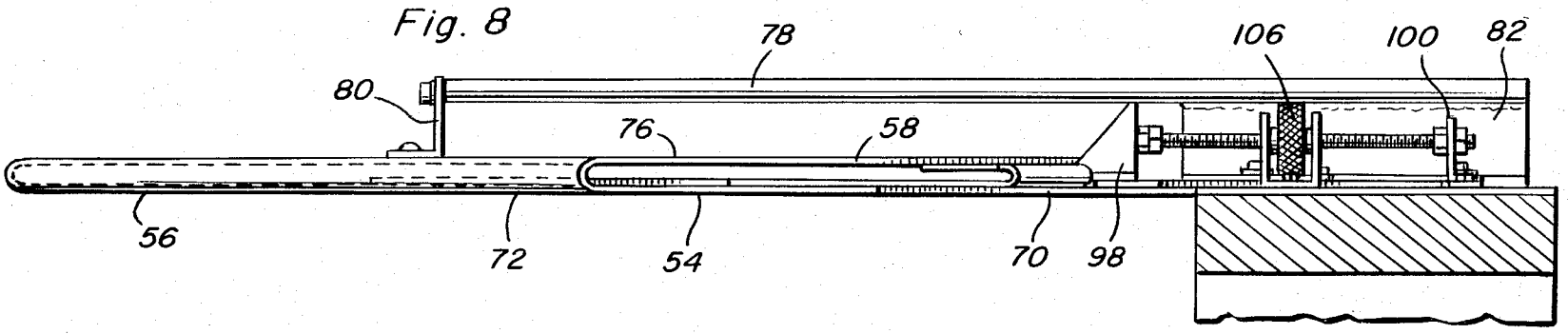
FIG. 8 is a side elevation view of the apparatus shown in FIG. 7.

The single folding operation for the travelling web 32 in response to its reversal in travel direction as explained with respect to FIGS. 4, 5 and 6 is accomplished by the package forming folder 12 which is shown in detail in FIGS. 7, 8 and 9. The folder includes a fixed and rigid supporting plate member or panel 70, made of sheet metal for example, presenting closely spaced lower and upper parallel surfaces 72 and 74 establishing the travel path for the web in its direction of travel in both directional senses. The lower surface 72 supports the web as it approaches the edge 54 formed on member 70 at which the intermediate transverse portion 38 of the web undergoes its 180° reversal in travel direction, as aforementioned, continuing to travel along the upper surface 74 in the opposite directional sense. The web folding edge 54 also constitutes the product receiving edge adapted to be aligned with the delivery end of the infeed synchronizer 18 as aforementioned, so that the product may be deposited onto the web portion 38, supported on surface 74, before the web portion 40 is folded thereover. The support member 70 which is generally rectangular as shown may be formed integral with and connected to a rigid triangular guide member 76 along the side edge 56 to effect a first 90° change in travel direction of the web portion 40. The guide member 76 extends transversely toward its free edge 58 in close parallel spaced relation to the support member 70 to support the web travelling thereabove before it undergoes a second 90° change in travel direction emerging from under the guide member at edge 58 as shown. It will be apparent from the foregoing description that the guide member 76 has a right isosceles triangle configuration with one leg formed by edge 58 intersecting edge 54 at vertex 66 and a second leg at edge 56. The hypotenuse of the triangle is formed by the base portion 84 of the guide member. A stiffener rod 78 is interconnected between the guide member 76 and underlying support member 70 by means of brackets 80 and 82 located adjacent to the base portion 84 of the guide member. A triangular guide member 86 smaller than and geometrically similar to guide member 76 is also fixedly mounted on the support member 70 in alignment with a rectangular cut-out or notch portion 88 therein to present the edge segments 60 and 62 as legs of the right isosceles triangle with the free edge 62 confronting edge 58 between the vertex 68 and the hypotenuse or base 90 of the guide member 86. Folding of lap seam web portion 36 is thereby effected by travelling above the guide member at right angles to the direction of travel before being undergoing a second 90° change in travel direction to emerge from under the guide member 86 at edge 62.

The triangular guide member 86 is fixedly mounted on support member 70 in adjusted position within the notch portion 88 of panel 70 as shown by means of a support plate 92 to which the guide member 86 is connected along guide edge 60. The transverse spacing between the triangular guide members 76 and 86 may be varied by means of a package size adjustment mechanism generally referred to by reference numeral 94. The mechanism 94 includes a screw shaft 96 rotatably mounted at opposite axial ends of spaced brackets 98 and 100 fixed to the support plate 92 which is slidably connected to the underlying support member 70 by a pin and slot connection 102. A bracket 104 fixed to the support member 70 between brackets 98 and 100 rotatably supports the screw shaft with an externally knurled adjusting nut 106 in threaded engagement with the screw shaft and axially fixed to support member 70 by abutment with bracket 104 through axial thrust washers. It will be apparent that manual rotation of nut 106 will cause axial displacement of screw shaft 96 relative to the support member 70 fixed to bracket 104 to thereby slidably displace the support plate 92 to which the screw shaft is axially fixed by the brackets 98 and 100. The pitch of the threads on the screw shaft are such as to provide a self-locking action to hold the plate 92 and the guide member 86 connected thereto in any adjusted position. By use of mechanism 94, webs of different widths may be accommodated in order to form packages more closely dimensioned to the collated sheet material being wrapped.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with means for feeding an unfolded web of flexible sheet material along a predetermined direction of travel, said unfolded web having longitudinally extending intermediate and side portions, a web folding device having a supporting surface panel guiding travel of the unfolded web along said direction of travel, and guide means for directionally changing travel of the web including an intermediate segment on the panel perpendicular to said direction of travel about which the intermediate portion of the web undergoes a single 180° change in travel direction and a pair of side segments of the panel extending at angles to the direction of travel about which the side portions of the web undergo 90° changes, respectively, in travel direction, the improvement comprising a pair of planar guide members respectively connected to said side segments and extending therefrom by different distances in said direction of travel parallel to the panel, each of said guide members including a free edge about which one of the side portions of the web undergoes a second 90° change in travel direction into overlapping contact with the other of the side portions to form a flat tube.

2. The web folding device as defined in claim 1 wherein each of said guide members forms a 90° vertex bisected by fold lines between said portions of the web extending parallel to the direction of travel.

3. The web folding device as defined in claim 2, including adjustment means for varying the spacing between the guide members transversely of the travel direction.

4. The web folding device as defined in claim 3 wherein one of the guide members is substantially smaller in dimension parallel to said travel direction whereby a folded portion of the web extends from the free edge in overlapping relation to another folded portion of the web extending from the larger of the triangular members.

5. The web folding device as defined in claim 1 wherein each of said guide members forms a 90° vertex bisected by fold lines between said portions of the web extending parallel to the direction of travel.

6. The package forming device as defined in claim 5 including package size adjustment means for varying the spacing between said spaced guide means.

7. The web folding device as defined in claim 1 including adjustment means for varying the spacing between the guide members transversely of the travel direction.

8. The web folding device as defined in claim 1 wherein one of the guide members is substantially smaller in dimension parallel to said travel direction whereby a folded portion of the web extends from the free edge in overlapping relation to another folded portion of the web extending from the larger of the triangular members.

9. The improvement as defined in claim 1 including feeding means for feeding flat products along said direction of travel approaching said intermediate segment of the panel, and means mounting the panel in alignment with the conveyor means at the intermediate segment for support of the products traveling across the intermediate segment onto the folded intermediate portion of the web overlying the panel.

10. In combination with a package forming web folder having a planar supporting surface along which a web travels and edge means for longitudinally folding the web between first and second longitudinally extending portions thereof during travel a first distance along the supporting surface, the improvement comprising secondary edge means mounted on the supporting surface in laterally spaced relation to the first mentioned edge means for guiding travel of a third longitudinal lap portion of the web a second distance less than said first distance while undergoing two sequential 90° changes in travel direction to longitudinally fold the lap portion into overlapping contact with the first longitudinal portion of the web and form a flat tube.

11. The improvement as defined in claim 10 wherein both of said edge means comprise planar members in close parallel spaced relation to the supporting surface, a guide edge terminating the supporting surface between the planar members about which the second portion of the web undergoes a single 180° change in travel direction, and connecting edges between the supporting surface and the planar members from which the members extend by said first and second distances, respectively.

12. In an apparatus for wrapping objects moving in a predetermined travel direction, comprising a frame, means for feeding a web of packaging material, said web having longitudinally extending interemdiate and side portions, and means fixedly attached to the frame for forming a continuous flat tube of the packaging material from the web, said tube forming means including a panel having an intermediate folding edge perpendicular to said travel direction of the objects and a pair of connecting edges extending at angles from the intermediate folding edge, the improvement comprising means mounting the panel on the frame for support of the objects transferred to the panel across the intermediate folding edge overlying the intermediate portion of the web, and a pair of planar guide members respectively extending from the connecting edges by different distances along the travel direction to sequentially complete folding of the side portions of the web in overlapping relation to each other to form said flat tube about the objects.

13. In a machine for wrapping products in film having: infeed means for moving the products to a forming station; a film supply providing an unfolded web of the film of a predetermined width to said forming station; film forming means located at said forming station for forming said film into a generally flat tube enveloping the products exiting from said infeed means, said flat tube having folded side edge portions; sealing means; and means for moving the flat tube exiting from the forming means past the sealing means such that a seal is formed between said folded side edge portions; the film forming means comprising a generally rectangular sheet of rigid material having an isosceles right triangle integrally formed therewith, one leg of the triangle being an extension of one side edge of the rectangular sheet and the other leg of the triangle being integrally joined to an edge of the rectangular sheet adjacent to said one side edge, said rectangular sheet being folded diagonally from a point of intersection of the hypotenuse of said triangle with said adjacent edge and an intersection of said one side edge and an edge of the rectangular sheet parallel to said adjacent edge of the rectangular sheet, a generally rectangular notch of a predetermined length and width dimension being formed inwardly from said adjacent edge of the rectangular sheet at a location spaced from said intersection of said hypotenuse with said adjacent edge, a further sheet of rigid material having a triangular projection folded parallel thereto and integrally joined thereto, and means for adjustably attaching said further sheet to said rectangular sheet with said triangular projection extending through said generally rectangular notch, the engagement of said unfolded web of film with the diagonal fold in said rectangular sheet folding said film web such that one of the side edge portions thereof extends in a first direction and engagement of said film web with said triangular projection folds the other of the side edge portions of said web in a direction opposite to said first direction.

* * * * *